US007121500B2

(12) United States Patent
Adams et al.

(10) Patent No.: US 7,121,500 B2
(45) Date of Patent: Oct. 17, 2006

(54) STACKABLE WINDING CORE AND METHOD OF MAKING SAME

(75) Inventors: Angela Adams, Hartsville, SC (US); Clifford A. Bellum, Hartsville, SC (US); Wim van de Camp, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 255 days.

(21) Appl. No.: 10/796,478

(22) Filed: Mar. 9, 2004

(65) Prior Publication Data

US 2005/0199764 A1 Sep. 15, 2005

(51) Int. Cl.
*B65H 75/14* (2006.01)

(52) U.S. Cl. ..... 242/605; 242/118.3; 242/610.1; 242/610.3

(58) Field of Classification Search ..... 242/610.1, 242/605, 610.3, 118.3; 493/287
See application file for complete search history.

(56) References Cited

U.S. PATENT DOCUMENTS

| | | | | | |
|---|---|---|---|---|---|
| 2,659,547 | A | * | 11/1953 | Broadbent et al. | 242/118.32 |
| 3,096,681 | A | * | 7/1963 | Burnside, III | 359/616 |
| 3,107,067 | A | | 10/1963 | Atwood et al. | |
| 3,248,070 | A | * | 4/1966 | Julien | 242/118.3 |
| 3,740,976 | A | * | 6/1973 | Fyans | 68/198 |
| 3,990,649 | A | * | 11/1976 | Adams | 242/118.32 |
| 4,702,433 | A | | 10/1987 | Gilljam et al. | |
| 4,946,114 | A | | 8/1990 | Becker et al. | |
| 5,169,087 | A | | 12/1992 | Romagnoli | |
| 5,354,008 | A | | 10/1994 | Honegger | |
| 5,469,297 | A | * | 11/1995 | Marshall et al. | 359/617 |
| 5,553,811 | A | | 9/1996 | Hahm et al. | |
| 5,564,646 | A | | 10/1996 | Clarelli | |
| 6,032,890 | A | | 3/2000 | DesRosiers | |
| 6,394,386 | B1 | * | 5/2002 | Lo | 242/610.3 |
| 6,558,306 | B1 | * | 5/2003 | Lowry et al. | 493/276 |
| 2003/0034413 | A1 | | 2/2003 | Pederson et al. | |
| 2004/0173712 | A1 | * | 9/2004 | Valls Roca et al. | 242/605 |

FOREIGN PATENT DOCUMENTS

| | | | |
|---|---|---|---|
| DE | 31 05 828 | A1 | 9/1982 |
| DE | 42 09 224 | A1 | 9/1993 |
| DE | 43 01 625 | A1 | 7/1994 |
| EP | 1 227 054 | A1 | 7/2002 |

OTHER PUBLICATIONS

Copy of European Search Report for European Application No. 05250896.7; Filed Feb. 16, 2005; Date of Completion Jun. 21, 2005.

* cited by examiner

*Primary Examiner*—William A. Rivera
*Assistant Examiner*—Sang Kim
(74) *Attorney, Agent, or Firm*—Alston & Bird LLP

(57) ABSTRACT

A stackable winding core in accordance with the invention has a male end and an opposite female end. The ends are configured in such a manner that they do not hinder or prevent the insertion of chucks or mandrels into the core for winding or unwinding of web material about the core. The male end of one core is receivable into the female end of another core so that the cores can be axially stacked end-to-end, the engagement between the ends of the cores keeping the core coaxially aligned with each other. The ends are also configured to support axial loads exerted between the cores.

7 Claims, 2 Drawing Sheets

STACKABLE WINDING CORE AND METHOD OF MAKING SAME

BACKGROUND OF THE INVENTION

The invention relates to tubular winding cores about which various materials are wound into rolls, and methods of making winding cores, wherein the cores are configured to facilitate rolls of wound materials being axially stacked end-to-end so they remain coaxial with one another.

Web materials such as paper, plastic film, metal foil, and others, are commonly provided to web converters (e.g., printers, laminators, surface treaters, packaging manufacturers, etc.) in the form of large rolls of the material. The web material is wound about tubular winding cores, which typically are formed of paperboard. It is a common practice to ship multiple rolls of material stacked vertically end-to-end in two or more layers on a pallet. A corrugated paper or plastic separator or slip sheet is positioned between adjacent layers to prevent the rolls from rubbing together and damaging the edges of the web material. The separators or slip sheets increase the cost of shipping the web material.

BRIEF SUMMARY OF THE INVENTION

The present invention provides stackable winding cores and methods for making such cores that can allow rolls of web material to be stacked end-to-end without separators or slip sheets between adjacent layers of the rolls. A stackable winding core in accordance with the invention has a male end and an opposite female end. The ends are configured in such a manner that they do not hinder or prevent the insertion of chucks or mandrels into the core for winding or unwinding of web material about the core. The male end of one core is receivable into the female end of another core so that the cores can be axially stacked end-to-end, the engagement between the ends of the cores keeping the core coaxially aligned with each other. The ends are also configured to support axial loads exerted between the cores.

The winding core can be produced in various ways. In one embodiment of the invention, a paperboard tube is produced in the usual fashion for making a winding core. The inner surface of the tube is machined at one end of the tube to increase the inside diameter and thereby produce a female end. At the opposite end of the tube, the outer surface is machined to reduce the outside diameter and thereby produce a male end that can fit into the female end of another core. In this manner, a core is produced having male and female ends, and nowhere is the inside diameter of the core less than that of the main portion of the core that extends between the male and female ends. Accordingly, chucks or a mandrel can be inserted into the core without hindrance.

In another embodiment of the invention, the winding core essentially comprises an inner tube disposed within an outer tube in an axially offset position such that an end portion of the inner tube extends out beyond the outer tube at one end, and at the other end the outer tube extends beyond the inner tube, thereby providing male and female ends. The inner and outer tubes are affixed to each other in suitable fashion to prevent relative movement between them.

The tube-in-tube embodiment can be produced by making an inner tube and separately making an outer tube, with the outside diameter of the inner tube being slightly less than the inside diameter of the outer tube. The inner tube can then be inserted into the outer tube and positioned in an axially offset position, and the tubes can be affixed to each other to prevent relative movement between them. Alternatively, in the case of a spirally wound paperboard winding core, a plurality of inner plies can be wound about a mandrel and adhered together to form an inner tube, and a plurality of outer plies can be wound about the inner tube and adhered together to form an outer tube surrounding the inner tube, while the interface between the tubes is free of adhesive. The resulting tube assembly can then be cut to the appropriate length for the core and the inner tube can be slid into an axially offset position with respect to the outer tube and the tubes affixed together to prevent relative movement.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
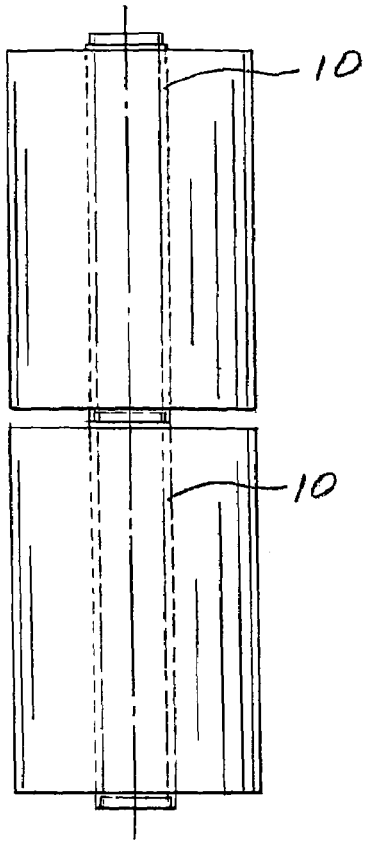
FIG. 1 is a front elevation of a pair of rolls of web material stacked one atop the other with respective male and female ends of the cores engaged in accordance with one embodiment of the invention.
Figure 2A:
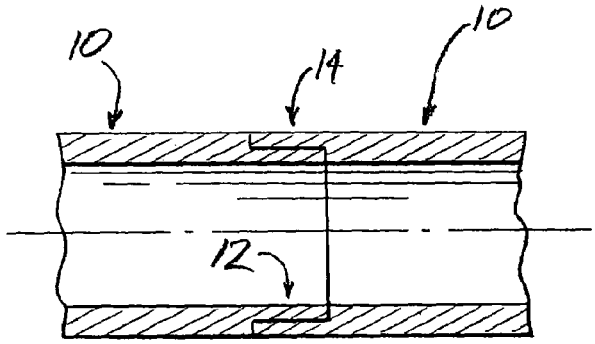
FIG. 2A is a fragmentary cross-sectional view on an enlarged scale relative to FIGS. 1 and 2, showing the male/female end engagement of two cores in accordance with the invention.
Figure 2:
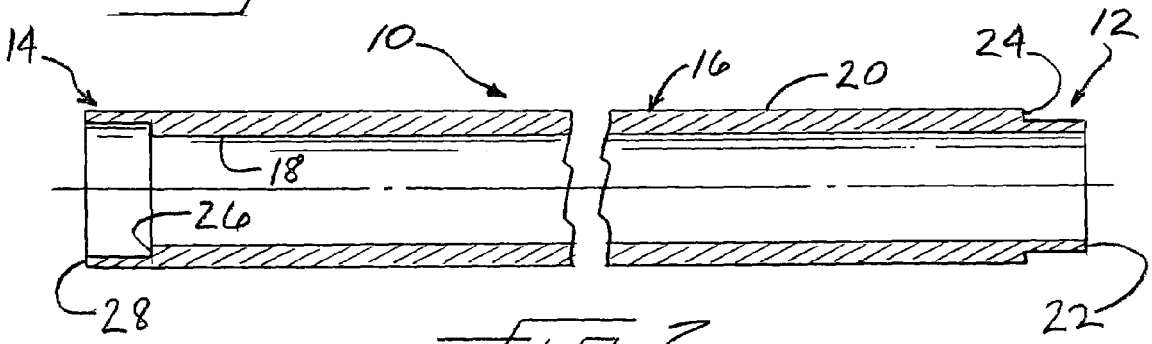
FIG. 2 is a cross-sectional view of a core in accordance with one embodiment of the invention.

FIGS. 1, 2, and 2A depict a winding core 10 in accordance with a first embodiment of the invention, and its usage for stacking rolls of web material wound on such cores. The winding core 10 comprises a generally cylindrical body having a length that exceeds the width of web material to be wound on the core, such that when the web material is wound into a roll, the opposite ends of the core project beyond the ends of the roll as illustrated in FIG. 1. The core includes a male end 12, an opposite female end 14, and a main portion 16 extending between and joined to the male and female ends. At least the main portion 16 comprises a paperboard tube; in a preferred embodiment, the main portion and the two ends are of one-piece integral construction and comprise a paperboard tube. The main portion has a cylindrical inner surface 18 and a cylindrical outer surface 20 each of constant diameter over substantially an entire length of the main portion.

The female end 14 has an inside diameter greater than the diameter of the cylindrical inner surface 18 of the main portion 16. The male end 12 has an outside diameter less than that of the main portion and less than the inside diameter of the female end 14 such that the male end of the core is insertable into the female end of another said core as shown in FIG. 2A. In a preferred embodiment of the invention, the amount by which the female end's ID exceeds the ID of the main portion (hereinafter referred to as the ID increase) is approximately equal to or slightly greater than half the radial wall thickness of the main portion, and the amount by which the male end's OD is less than the OD of the main portion (hereinafter referred to as the OD decrease) is approximately equal to or slightly greater than half the wall thickness of the main portion. At any rate, the sum of the ID increase and the OD decrease preferably is slightly greater than wall thickness of the main portion so that the male end can fit into the female end without interference therebetween.

Preferably, the core nowhere has an inside diameter less than the diameter of the cylindrical inner surface 18 of the main portion. This enables winding chucks or mandrels to be inserted into the core without interference.

The male and female ends can be created in various ways. In one embodiment, as illustrated in FIG. 2, the male and female ends comprise integral extensions of the main portion 16 on which web material is wound. The male end 12 can be formed by starting with a cylindrical tube of uniform OD and ID along its length, and machining the outer surface at one end to reduce the OD along a portion of the tube's length. Likewise, the female end is formed by machining the inner surface at the opposite end of the tube to increase the ID along a portion of the tube's length.

Each of the male and female ends defines at least one surface, referred to herein as a "stacking surface", for bearing axial compressive loads exerted between two cores having their respective male and female ends engaged as in FIG. 2A. In a preferred embodiment, each end defines two such stacking surfaces. More particularly, with reference to FIG. 2, the male end defines a first stacking surface 22 at the end of the male end, and a second stacking surface 24 defined by a step between the reduced-OD portion and the main portion of the core. The female end defines a first stacking surface 26 defined by a step between the increased-ID portion and the main portion, and a second stacking surface 28 at the end of the female end. The axial length of the male end is substantially equal to that of the female end. Consequently, when the male end of one core is inserted fully into the female end of another identical core as in FIG. 2A, the first stacking surface 22 of the male end abuts the first stacking surface 26 of the female end, and the second stacking surface 24 of the male end abuts the first stacking surface 28 of the female end.

In other embodiments (not shown), the male end can be longer than the female end, in which case the first stacking surfaces 22, 26 will abut but the second stacking surfaces 24, 28 will be spaced apart when the male end is fully inserted into the female end. Alternatively, the male end can be shorter than the female end, in which case the second stacking surfaces will abut while the first stacking surfaces will be spaced apart. Preferably, however, as noted above, the male and female ends have the same length so that both pairs of stacking surfaces abut, thereby providing maximum total surface area for bearing axial loads between the cores.

Figure 3:
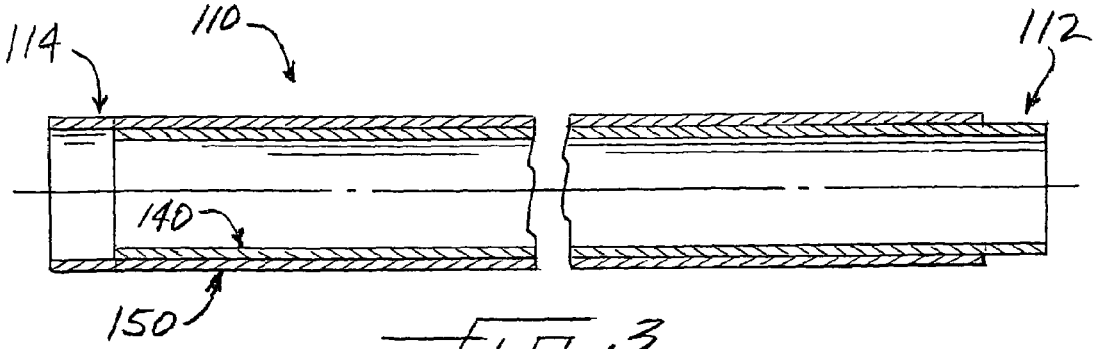
FIG. 3 is a cross-sectional view of a core in accordance with another embodiment of the invention.

As noted, the above-described core can be manufactured by first producing a paperboard tube and then machining the opposite ends to form the male and female ends. In alternative embodiments of the invention, described below in connection with FIGS. 3, 4, 5A, and 5B, a core with male and female ends can be produced as a "tube-in-tube" construction, in at least two different ways. FIG. 3 shows a core 110 of the tube-in-tube type in accordance with the invention. The core comprises an inner tube 140 concentrically disposed within an outer tube 150. The inner tube is axially offset relative to the outer tube, such that one end of the inner tube projects out beyond the corresponding end of the outer tube, while the opposite end of the inner tube is recessed within the outer tube, thereby creating a male end 112 at the one end and a female end 114 at the opposite end of the core. The inner tube is affixed by suitable means (not shown) to the outer tube to prevent relative movement or slipping therebetween. This can be accomplished by an adhesive applied between the tubes, by mechanical means (e.g., fasteners such as staples or the like extending through both tubes), or in other ways.

The tube-in-tube core can be produced, in one embodiment, by separately making the inner tube and the outer tube, of appropriate lengths and diameters, and then inserting the inner tube into the outer tube and affixing the tubes together. The outer diameter of the inner tube preferably is slightly less than the inner diameter of the outer tube so that the inner tube can be inserted into the outer tube without interference therebetween.

Figure 4:
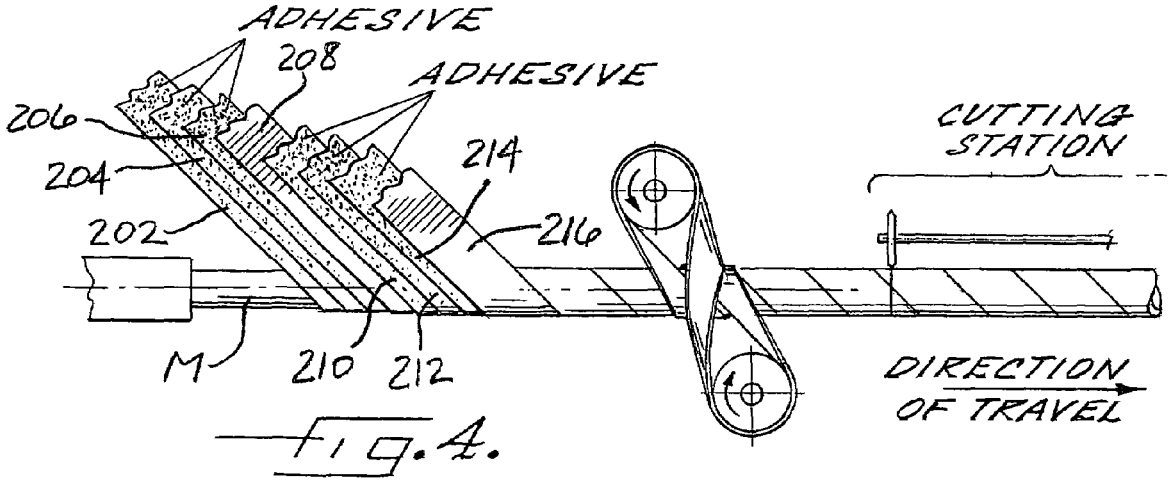
FIG. 4 is a diagrammatic depiction of an apparatus and process for making a tube used in the production of a core such as shown in FIG. 3.
Figure 5A:
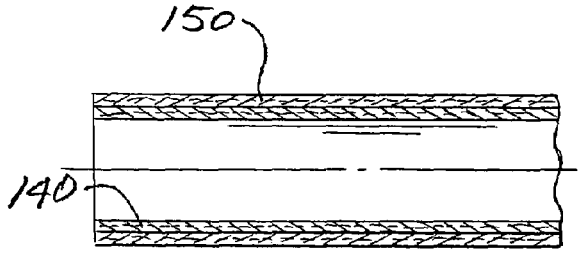
FIG. 5A is a cross-sectional view of a tube made by the apparatus and process of FIG. 4.
Figure 5B:
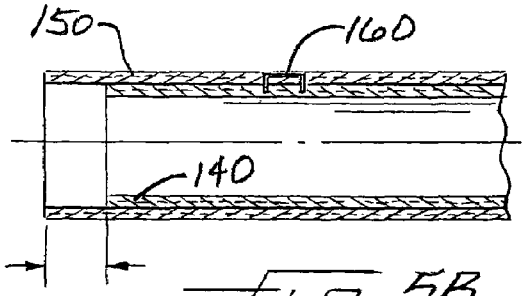
FIG. 5B is a view similar to FIG. 5A, showing a finished core made from the tube.

In an alternative embodiment, the tube-in-tube core is constructed by a "slip ply" technique in a spiral winding process, as now described with reference to FIGS. 4, 5A, and 5B. The process is generally similar to a conventional spiral winding process for producing paperboard tubes, wherein a plurality of paperboard plies are spirally wound onto a cylindrical mandrel and are joined together by adhesive applied to the plies. In a conventional process, adhesive is applied between all abutting surfaces of all plies. This process is modified for the present invention, such that a ply-to-ply interface at or near the middle of the tube wall thickness is devoid of adhesive, and hence the plies on either side of the interface can slip relative to each other. Thus, in FIG. 4, a plurality of inner plies 202, 204, 206, 208 are spirally wound one atop another onto the mandrel M. The ply 202 is directly against the mandrel and the ply 208 is farthest from the mandrel in the radial direction; plies 204 and 206 are radially between the plies 202 and 208. Adhesive is applied by suitable applicator devices (not shown) to the outer surfaces of the plies 202, 204, and 206 that face away from the mandrel, but no adhesive is applied to the outer surface of the ply 208. The inner plies 202, 204, 206, 208 thus are adhered to one another by the adhesive to form an inner tube on the mandrel.

A plurality of outer plies 210, 212, 214, 216 are wound atop the inner plies. Adhesive is applied to the outer surfaces of plies 210, 212, and 214, so that the plies 210, 212, 214, 216 are adhered together to form an outer tube surrounding the inner tube on the mandrel. However, there is no adhesive between plies 208 and 210. Accordingly, these plies can slip relative to each other. Thus, the inner tube formed by plies 202-208 can slip relative to the outer tube formed by plies 210-216.

The composite tube formed on the mandrel is cut at a cutting station into appropriate lengths for forming cores. FIG. 5A shows a length of composite tube, comprising inner tube 140 and outer tube 150. The next step in the process of making the core is to slide the inner tube 140 axially relative to the outer tube 150 and then affix the tubes together by staples 160 or other means to prevent further relative movement between the tubes.

Figure 6:
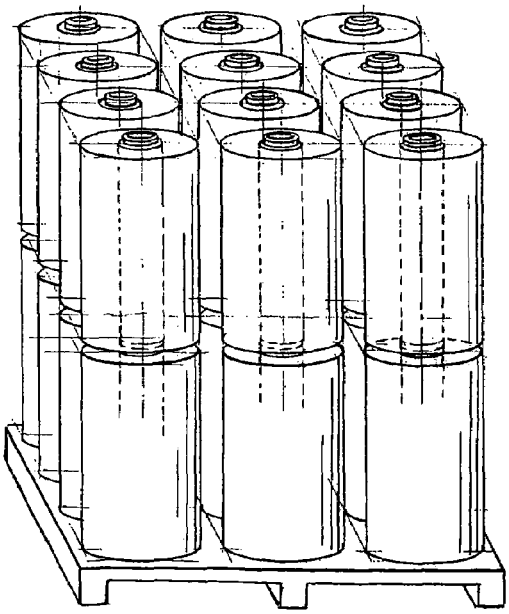
FIG. 6 is a perspective view of a pallet of web material rolls stacked with the assistance of cores in accordance with the invention.

The stackable winding cores in accordance with the invention allow rolls of web materials to be stacked to create multiple layers on a pallet, as shown in FIG. 6, without requiring the corrugated separator sheet that heretofore has been needed to prevent damage to the edges of the web material caused by contact between rolls. The male and female ends of the core extend beyond the web edges, and the engagement between the male and female ends of adjacent cores maintains the cores coaxially aligned with each other and maintains axial space between the edges of the web material wound on the cores so that damage to the web edges is avoided.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A stackable winding comprising:

an inner paperboard tube having a radially outer surface and a radially inner surface;

an outer paperboard tube having a radially outer surface and a radially inner surface;

the inner paperboard tube being coaxially disposed within the outer paperboard tube such that the radially outer surface of the inner paperboard tube forms an interface with the radially inner surface of the outer paperboard tube;

the interface being devoid of adhesive and the inner paperboard tube being axially offset with respect to the outer paperboard tube such that one end of the inner paperboard tube projects beyond the outer paperboard tube and forms a male end of the core and an opposite end of the outer paperboard tube projects beyond the inner paperboard tube and forms a female end of the core, and further comprising a fastener that affixes the outer paperboard tube and the inner paperboard tube together to prevent relative movement therebetween, the male end of one core being insertable into the female end of another core for stacking the cores end-to-end.

2. The stackable winding core of claim 1, further comprising:

a first stacking surface defined by one of the male and female ends, and a second stacking surface defined adjacent the other of the male and female ends, the first and second stacking surfaces being nonparallel to a longitudinal axis of the core and structured and arranged such that the first and second stacking surfaces abut each other when the male end of the core is inserted in the female end of another said core.

3. The stackable winding core of claim 2, wherein the first stacking surface comprises an end surface of the inner paperboard tube and the second stacking surface comprises an opposite end surface of the inner paperboard tube.

4. The stackable winding core of claim 2, wherein the first stacking surface comprises an end surface of the outer paperboard tube and the second stacking surface comprises an opposite end surface of the outer paperboard tube.

5. The stackable winding core of claim 4, further comprising a third stacking surface formed by an end surface of the inner paperboard tube and a fourth stacking surface formed by an opposite end surface of the inner paperboard tube, the third and fourth stacking surfaces being structured and arranged to abut each other when the male end is inserted into the female end of another said core.

6. The stackable winding core of claim 1, wherein the fastener comprises a staple.

7. The stackable winding core of claim 1, wherein the inner paperboard tube comprises a spirally wound tube having a plurality of paperboard plies spirally wound one upon another and adhered together with adhesive, and the outer paperboard tube comprises a spirally wound tube having a plurality of paperboard plies spirally wound one upon another and adhered together with adhesive.

* * * * *

UNITED STATES PATENT AND TRADEMARK OFFICE

CERTIFICATE OF CORRECTION

PATENT NO. : 7,121,500 B2
APPLICATION NO. : 10/796478
DATED : October 17, 2006
INVENTOR(S) : Adams et al.

It is certified that error appears in the above-identified patent and that said Letters Patent is hereby corrected as shown below:

Column 5, line 28, after “stackable winding” insert --core--.

Signed and Sealed this

Twenty-seventh Day of November, 2007

JON W. DUDAS
*Director of the United States Patent and Trademark Office*